United States Patent [19]

Tremblay

[11] Patent Number: 4,623,100

[45] Date of Patent: Nov. 18, 1986

[54] SPOOLING MACHINE, ESPECIALLY FOR FLAT WIRE

[75] Inventor: Bruce R. Tremblay, Auburn, Me.

[73] Assignee: North American Philips Corporation, New York, N.Y.

[21] Appl. No.: 709,966

[22] Filed: Mar. 11, 1985

[51] Int. Cl.[4] ..... B65H 54/28

[52] U.S. Cl. ..... 242/25 R; 242/158 R

[58] Field of Search ..... 242/25 R, 158 R, 158.4 R, 242/158.2, 7.11, 7.14, 7.15, 7.16, 43 R

[56] References Cited

U.S. PATENT DOCUMENTS

| | | | |
|---|---|---|---|
| 2,345,601 | 4/1944 | Hickes | 242/43 R |
| 3,031,153 | 4/1962 | Attwood et al. | 242/158 R |
| 3,544,035 | 12/1970 | Woolever | 242/158 R |
| 3,779,480 | 12/1973 | Cambou | 242/158 R |
| 4,022,391 | 5/1977 | Stein et al. | 242/25 R |
| 4,083,515 | 4/1978 | Dickerson | 242/158 R |
| 4,086,472 | 4/1978 | Sikora | 242/158 R X |
| 4,173,312 | 11/1979 | Camardella | 242/7.11 |
| 4,244,539 | 1/1981 | Taneda et al. | 242/158 R |
| 4,274,603 | 6/1981 | Lenders et al. | 242/25 R X |
| 4,421,284 | 12/1983 | Pan | 242/158 R |
| 4,456,199 | 6/1984 | Seibert | 242/158 R |
| 4,493,463 | 1/1985 | Rivinius | 242/158 R |

FOREIGN PATENT DOCUMENTS

| | | |
|---|---|---|
| 124180 | 10/1977 | Japan . |
| 1253614 | 11/1971 | United Kingdom . |

*Primary Examiner*—Stanley N. Gilreath

*Attorney, Agent, or Firm*—Robert T. Mayer

[57] ABSTRACT

A spooling machine for winding wire, especially having a non-circular cross-section. A traverse mechanism reciprocates a wire guide or the spool relative to each other, the guide following a relative path such that at the end of a layer the guide clears the spool flange with a small clearance. Upon completion of one layer, the traverse proceeds in the new direction at a high rate of speed for a transition period corresponding to one-fourth to one-third lay, so as to place a relatively sharp bend in the wire where it climbs from the last turn of one layer to the first turn of the next.

10 Claims, 4 Drawing Figures

SPOOLING MACHINE, ESPECIALLY FOR FLAT WIRE

BACKGROUND OF THE INVENTION

1. FIeld of the Invention

The invention relates to machines for winding wire or similar elongated materials on a spool having a circular cylindrical core and end flanges; and more particularly, to such a machine with which it is desired to wind very neatly layered coils having successive layers running in opposite helical directions.

Spooling machines, of greater or lesser complexity, have been in use for many years for winding cordage, wire, thread, and tape-like materials. Neatness of winding has long been recognized as desirable because this reduces snagging of the material when it is subsequently unwound from the spool, and also because it maximizes the total length of material which can be wound on a given spool. The seriousness of the problems encountered in spooling operations is a function both of the characteristic of the material to be wound, and the configuration of the spool. Maximum storage density calls for the use of a spool having a minimum core diameter consistent with the characteristics of the cross-section of the material to be wound. An added complication, which relates to the characteristics of the material being wound, is that some materials exhibit a relatively high friction which tends to cause one turn to climb onto the next preceding turn, rather than lying alongside. The regularity of the surface or cross-section of the material also affects the ease with which one turn can be caused to lie neatly alongside the next preceding turn, or to follow a regular helical pattern onto a layer underneath. All of these problems become especially important if the material to be wound has a surface coating which is fragile or is easily damaged.

Special constraints on the spooling techniques are imposed whenever the material being spooled is coming from a process machine, and the nature of the upstream process requires that the material leaving that process be handled in a particularly gentle way. For example, metal wire is normally considered to be relatively strong. However, for certain applications relatively thin, flat wire configurations are desired using high cost materials such as tungsten or molybdenum which may, in addition, have gold plating applied to the exterior. Such a wire or ribbon coming from the plating machine must be taken up on a spool with extremely low tension, while at the same time especially regular spooling is desired without harsh rubbing of one turn over the edge of the next preceding turn. 2. Description of the Prior Art Automatic spooling machines have been in use for many decades, with the nature of the machine control and mechanization being related to the economic importance of optimizing the resulting layers or turns. Thread, string and other cordage can be sold in very large quantities more easily and economically if they are wound in neatly spooled packages. Therefore relatively sophisticated machines using various mechanically controlled guiding systems have been used. However, these materials were neither especially fragile nor hard to handle.

Where relatively small quantities of hard-to-handle materials are to be spooled, the use of sophisticated purely mechanical control systems is disadvantageous because of the large set-up time involved; and also sometimes because of the relatively high maintenance costs involved for these machines.

The advantage of an electrical feedback control system for spooling is described in U.S. Pat. No. 3,779,480. The machine disclosed in this patent utilizes a sensing arm for detecting the angle at which heavy, stiff cable approaches the "run-on" point where the cable comes in contact with the spool core or the underlying layer. The desired transition between one layer and the next is described as being formed by having a traverse mechanism, by which a spool onto which cable is wound is translated back and forth in the direction of the spool axis, come to a stop while a first turn of a new layer is wound substantially parallel and to and in contact with the end flange. After the first turn of a new layer has been formed, substantially parallel to and in contact with the end flange, the portion of the cable approaching the run-on point is deflected sideways or axially by the characteristics of its smooth cylindrical surface, which militates against the formation of a next turn directly on top of the first turn. This axial displacement of the portion of wire is detected by a sensor, which causes the traverse mechanism to commence moving the spool in such a way that the cable approaching the spool is perpendicular to (that is, lies in a plane perpendicular to) the spool axis; while the cable being actually wound on the spool has a helix lead angle which is a function of the ratio of the diameter of the cable to the diameter of the layer being wound. Thus, this patent suggests that the lead angle of the material being wound should be 0°, so that there is not need to reverse a direction of lead angle for the two directions of traverse.

More recently, a far more sophisticated spooling machine is described in U.S. Pat. No. 4,022,391. In this spooler the spool rotational velocity is measured by a tachometer; the position of the spool traverse mechanism is measured by a position sensor such as a potentiometer or a digital position sensor; and the lead angle of the portion of wire between a fixed guide pulley and the run-on point is also measured. All of these values are fed to a processing circuit which controls in different ways the operation of the traverse motor in each of two phases of winding. During the normal phase, after enough turns of a new layer have been wound, the attitude angle by which wire approaches the run-on point is adjusted to a lagging angle, so as to force each new turn tightly against the preceding turn. The traverse mechanism will now operate at a substantially constant velocity until the run-on point has reached a predetermined distance from the end flange for this layer.

During a transition phase, as the wire wraps approach the flange, the angle of attitude is varied so as to reach zero just as the last turn touches the end flange. Preferably, this involves a continuous and uniform change in traverse speed. As in the U.S. Pat. No. 3,779,480 described above, the traverse continues at zero until one or more turns of the next layer have been wound, when the traverse resumes at its normal rate.

The machines described in the above patents suffer the disadvantage that it is difficult to obtain neat windings when the article to be wound does not readily slip into place alongside the next previous turn. Thus, especially if a delicate flat ribbon is to be wound at low tension, the machines of the prior art are apt to produce uneven transition turns at the end of a layer, with resulting damage to the wire if it is delicate.

SUMMARY OF THE INVENTION

An object of the invention is to spool wire reliably, with ready adjustment of the spooler to match different dimensions of wire.

Another object of the invention is to produce a wire spooler which does not require a sensor detecting the actual position of wire approaching the run-on point, so that difficult-to-align devices or forces against the wire are avoided.

Yet another object of the invention is to provide a spooler which produces neat, even transition turns at the beginning of a layer, so as to avoid pile-up of turns or twisting of a flat wire being wound.

According to a first aspect of the invention, neat winding is obtained in a spooler by guiding the wire using a guide element which is maintained as close as possible to the run-on point while at the same time being clear of the spool end flanges, so that winding can be guided with an attitude or lead angle which matches the helix lead angle virtually until the last turn of wire in a layer touches the end flange. Preferably, the guide element has two pins, transverse to the spool axis and the direction of wire movement, between which the wire passes with freedom to move in a direction parallel to the two pins.

According to a second aspect of the invention, in a spooling apparatus especially useful for spooling wire having a non-circular cross-section, the traverse mechanism operates at a high rate of speed during a brief transitional phase upon completion of a traverse for one full layer, such that the relative position of the wire guide with respect to the spool is advanced a distance preferably equal to approximately one-quarter or one-third normal lay (normal lay being the nominal traverse distance for one revolution of the spool). Thereafter, for the balance of that layer, the traverse operates at a normal speed such that the lead angle of the wire between the guide and the run-on location is approximately equal to the lead angle of the helix formed by the turns of the layer. Preferably a control system for the traverse mechanism compares the digital output of an absolute position encoder which senses the relative traverse position, a digital pulse device and counter which sense the accumulated turns and fractions of turns of spool rotation during winding of a layer, and preset values for the spool width between flanges and for the desired nominal lay distance so that the traverse motor is controlled by comparing actual position with a predetermined position, rather than by measuring and comparing speeds per se. This aspect of the invention is of particular value for use in winding of relatively flat wire, having a width-to-thickness ratio of at least three to two and more commonly of between approximately three to one and four to one.

According to a third aspect of the invention, a wire guiding arrangement includes two guide elements, each guide element having two parallel pins spaced apart a distance slightly greater than the wire width, as observed in the axial direction of the drum. The two guide elements are spaced from each other, in the direction of wire travel toward the run-on point, a distance less than the core diameter of the spool. The two legs of a guide element define a plane which is substantially perpendicular to the average direction of wire travel from the guide toward the run-on point, and the guide which is closer to the run-on point is spaced as close as possible to the spool axis, so that at the end of each winding pass the guide element overlaps the spool flange with only slight clearance. Particularly when winding relatively thin flat wire, having a width to thickness ratio in the range of three to one or four to one, an optimum combination of accuracy in spooling plus efficient storage of substantial quantity of wire on the spool is met through the use of a spool having a flange diameter which is no more than approximately 125% of the core diameter, so that between the first layer and last layer the wire passing between the guides and the run-on location has only a relatively small change in angle as viewed in the axial direction of the spool. When winding flat wire having three to one or four to one width-to-thickness aspect ratio, the normal lay distance is selected preferably to be slightly greater than the greatest width of the wire, so that there is no tendency for one edge of the thin wire to ride up occasionally over the edge of the previous turn. This aspect of the invention provides a great increase in the accuracy of spooling, with neat transition turns.

In a preferred embodiment of this last aspect of the invention, which is especially useful in winding wire coming from a process machine where it is desirable to have a long unsupported span of wire of the order of 10 to 100 times the spool core diameter, extending from the process machine to the spooler, in addition to the two guide elements the guide system includes a pair of guide pins or rollers arranged between the two guide elements, but having the pin or roller axes approximately parallel to the spool axis, so that this additional guide structure keeps the flat wire from twisting about its longitudinal axis.

These aspects and other advantages of the invention will be discussed with respect to a preferred embodiment of the invention shown in the drawing.

DESCRIPTION OF THE PREFERRED EMBODIMENT

Figure 1:
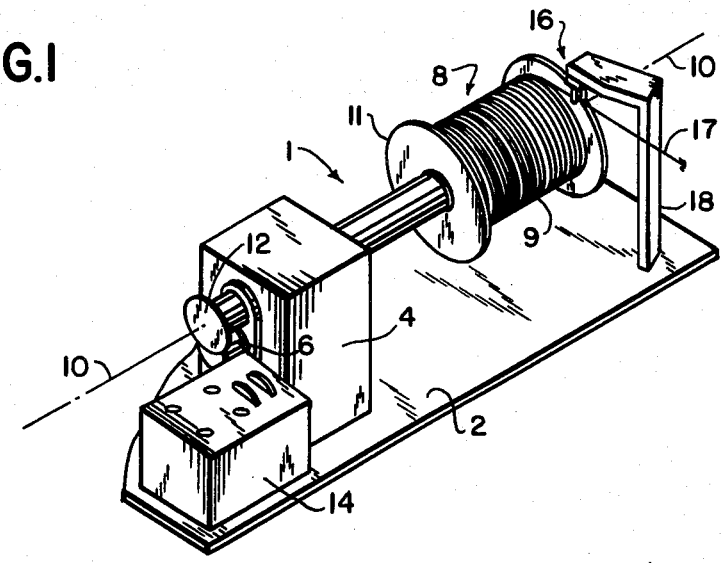
FIG. 1. is a perspective diagrammatic view of a spooling machine in accordance with the invention, for simplicity showing only one guide element.

FIG. 1 shows diagrammatically a spooling apparatus 1 comprising primarily a frame 2 to which is rigidly mounted a traverse mechanism 4 and rotational drive motor 6, which cooperate to move a spool 8, having a core 9 and a flange 11, translationally in the direction of a spool axis 10, and to rotate the spool about that axis. A pulse pick-off 12 mounted to the drive motor 6 generates a pulse string indicative of the incremental rotational position of the spool 8, the pulse string being connected to a control box 14. Also connected to the control box 14 is a signal from an absolute position encoder, not shown in this view, which forms part of the traverse mechanism 4 and provides a digital signal to the control box representative of the instantaneous traverse position of the spool. A wire guide arrangement 16 is indicated generally, guiding wire 17 which is being wound on the spool 8. The guide arrangement 16, which is described in more detail with respect to FIGS. 2 and 3, is fixed with respect to the frame 1 by a bracket 18.

Figure 2:
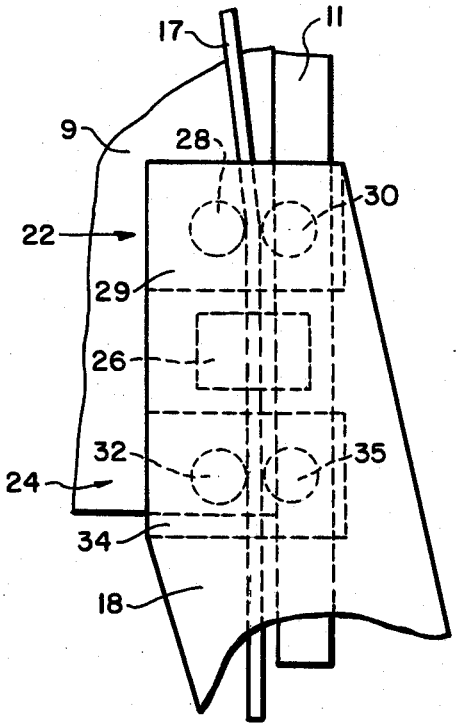
FIG. 2 is a plan view, on a greatly enlarged scale, of the guide arrangement in the apparatus of FIG. 1, showing both guide elements.
Figure 3:
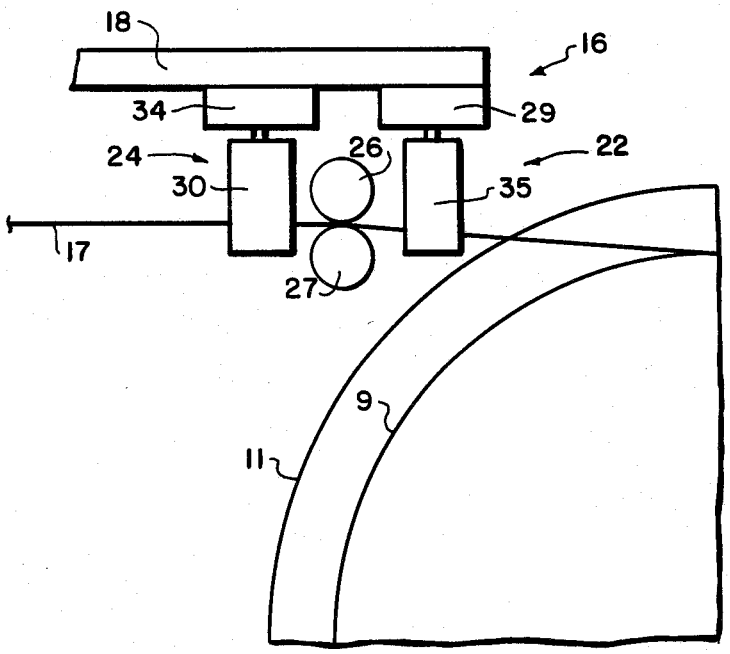
FIG. 3 is an end elevation of the guide arrangement apparatus of FIG. 1.

As shown at a greatly enlarged scale in FIGS. 2 and 3, with various dimensions exaggerated for drawing clarity, the wire guide arrangement 16 includes a first guide element 22 and a second guide element 24 each rigidly fastened to the bracket 18, and two guide pieces or rollers 26, 27 secured by means (not shown) to the bracket 18. More particularly, the first guide element 22 is a U-shaped element having a fixed leg 28 fastened to a base 29, and an adjustable leg 30, also fastened to the base 29, but adjustable as will be described hereinafter in its spacing from the leg 28. Similarly, the second guide element has a fixed leg 32 like the leg 28, permanently secured to a base 34, and an adjustable leg 35 like the leg 30, adjusted to be in line with the adjustable leg 30.

In accordance with one aspect of the invention which is of particular value in the winding of flat wire, the spool 8 and guide arrangement 16 dimensions are proportioned to enable the guide arrangement to be effectively quite close to the run-on location along the spool, and to provide a relatively sharp change in the helix lead angle when the transition turn is being laid. The following approximate dimensions describe a machine which is intended to provide high quality spooling of flat wire or ribbon, made of tungsten or molybdenum, having a thickness between approximately 50 and 175 microns (0.002" to 0.007") and a width between approximately 175 and 770 microns (0.007" to 0.032"). In general, the wire will have a width-to-thickness ratio of three or four to one, with a roughly rectangular cross-section, such that climbing of one edge of a wire turn over the edge of the next preceding turn can be a problem using prior art spoolers. The wire is thick enough so that it behaves like a substantially rigid body across its transverse section.

Contrary to past practice, when using a 100 mm (4") diameter core, the flange diameter has been limited to 113 to 125 mm (4½" to 5") diameter so that the distance between the guide arrangement and the run-on point is minimized, as compared with the situation in which the guide arrangement must be spaced from the run-on point by a distance greater than the flange radius. For spooling plain flat wire, the four legs forming the guide arrangement may each be made from very hard cylindrical pins having a diameter of approximately 4.75 mm (3/16"), the two parallel legs forming each guide element being spaced from each other by a distance slightly greater then the maximum width of the wire to be wound. This spacing is set by moving the adjustable leg with respect to the base part 29 or 34 of the element.

A machine intended to spool gold-plated wire coming from a plating apparatus many feet away, having a suspended length of wire free between the machine and the spooler, differs from the diagrammatic view of FIG. 1, in that the entire rotational drive mechanism is reciprocated by the traverse mechanism. This machine uses two of the guide elements spaced about 25 mm (1") apart in the direction of wire travel. Between the two guide elements two guide pieces or rollers are placed to prevent twisting of the wire about its longitudinal axis. To prevent smearing of the gold, the legs 28, 30, 32, 35 and the horizontal pieces 26, 27 are preferably made as plastic rollers about 9 mm (3/8") diameter.

It has been found desirable that the guide arrangement should have the most direct effect possible on the location of the run-on point of the wire. This calls for placing the guide as close as possible to the surface of the layer being wound, while at the same time maintaining a simple and rugged structure. For this reason, the spool flanges are maintained at a maximum diameter which is only slightly greater than the level of the last layer of a full spool. Further, when the guide arrangement is at the end of a pass such that one of the legs has a free end overlapping the flange, a minimum clearance is provided between the leg free end and the flange. For the apparatus described above, a convenient clearance may be of the order of 1.5 mm (1/16").

When winding wire as described above, where the previous process step was a gold plating step, the spooling drum rotation must be very slow, for example as low as 1 rpm to 5 rpm. This of course calls for a correspondingly low traverse speed.

A particular traverse mechanism unable for such low speed spooling incorporates a dc servo motor which, with its step-down gearing and control circuitry, provides a slew or maximum speed of about 0.37 meter (15") per minute. To provide neat end transitions between one layer and the next, when the end of a layer is reached the traverse mechanism is given a "kick" ahead in the opposite direction, by a control signal calling for a position change equivalent to ¼ to ⅓ lay. For the relatively small flange heights described, ¼ lay has been a satisfactorily preferred kick. This kick is produced by operating the traverse motor at its slew speed, which is preferably at least 10 times the normal traverse rate. Thus, the kick occurs during a time that the spool rotates no more than 1/40 to 1/30 of a revolution, and it has been observed when winding flat wire as described above that a distinct bend is formed in the wire at the run-on location when the kick takes place, and the wire then climbs immediately and precisely up to the beginning of the next layer.

Figure 4:
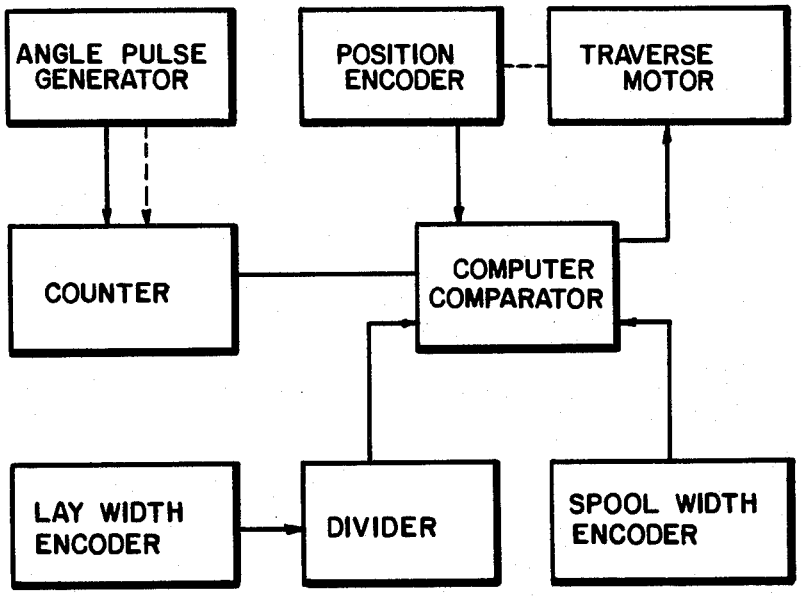
FIG. 4 is a schematic block diagram of the end view, on a greatly enlarged scale of the guide arrangement shown in FIGS. 2 and 3.

The control circuitry for this apparatus is shown schematically in the block diagram of FIG. 4. For a spooler as described above, having the capability of a maximum length of spool of 101.6 mm (4.0000"), a multi-turn absolute position encoder has a digital output in which the maximum travel distance is divided into 65,536 parts, to provide a digital resolution of 0.155 microns (0.000061"). To generate a rotation signal, an incremental angular digital sensor having two phase shifted outputs, thereby being direction sensitive, develops 256 pulses per spool revolution. Thus, for each pulse from the angle increment sensor, indicative of a rotation of 1/256 revolution, the traverse should have advanced by 1/256 of a lay width. Therefore, a lay width encoder, for example a four-digit thumb wheel switch, may be settable for a lay from 0 to 5.08 mm (0.2000"). The output of the encoder is divided by 256 to establish a value used by a positioning program in a microcomputer comparator.

For determining the point at which traverse should be reversed, a spool width encoder is also provided. This may be a four-digit thumb wheel switch encoder, into which spool width information may be set manually corresponding to spools from 0 to 101.6 mm (0.000 to 4.000"), or a similar resolution read-out may be provided from an optical sensor which directly reads the distance between the two flanges.

In addition to the above-described controls, the control box 14 advantageously contains ZERO and START and POWER switches. When the POWER switch is turned on, and ZERO is pressed, the traverse goes to the ZERO position. In this location, the operator may manually insert the end of a wire through a hole in the core of the spool immediately adjacent the flange at the START or ZERO end. At the same time, the lay width encoder and spool width encoder values will be set in. When START is pressed, the microprocessor in the computer comparator reads the lay thumb wheel, divided by 256, to establish a value used by the program for positioning, and starts the spooler motor. Each time a pulse is generated by the angle increment pulse generator, indicative of an advance of the spool by 1/256 revolution, the program determines the direction in which the spool is rotating and adds or subtracts 1/256 of the lay from the desired position. The program then jumps to a positioning program which takes the absolute position from the absolute position encoder, compares it to the desired position, and generates an error signal which drives the traverse motor. The program stays in this loop continuously until another pulse from the shaft angle increment encoder interrupts the program, determines another desired position, and causes the program to jump to the positioning program loop. This process continues until the upper limit value from the spool width encoder is reached. At this point, the traverse steps in the opposite direction a value equal to $\frac{1}{4}$ of the normal lay distance, and then resumes normal positioning.

This method of spooling synchronizes the traverse reverse and normal advance accurately and simply, even when operating at such low speeds that normal tachometer readouts are unreliable. Further, by utilizing absolute position readouts a transition turn kick is accurately and reliably provided, so that neat transitions are formed from one layer to the next avoiding pileups or twisting of the wire at the layer ends.

It will be obvious to those of ordinary skill in the art that many variations on this embodiment may be desirable for specific applications, or to suit other preferences in machine design. For example, limit switches may be added to prevent an attempt by the program to drive the traverse beyond the permitted travel range in the event of program malfunction, or error in setting the spool width encoder. The lay width encoder could also be provided as an automatic feature, utilizing an optical readout of the actual width of the wire being spooled and adding an appropriate increment to provide a very small separation between adjacent turns, when flat wire is being wound, so that minor variations do not cause one edge to ride up on a preceding turn. Similarly, the adjustment of the spacing between the pins of a guide element could be automated, particularly if a machine were to be used in a situation in which wire of a very great many different widths was to be wound, or in which for some reason due to process control the width of the material being wound might vary significantly over the total length of a wire.

For simplicity in program logic, the traverse motor may be selected as a stepper motor, with a drive mechanization such that one step of the motor provides a traverse equal to one digital unit advance in the absolute position encoder for the traverse. Alternatively, a stepper motor providing finer resolution could be provided, with appropriate program control of the traverse movement speed; or a conventional servo motor could be utilized to drive the traverse mechanism to cause the position encoder output to increase or decrease to the value determined from a comparison of the shaft angle count with the divided lay width encoder signal.

The spooling apparatus itself, independent of the type of electronic control, may with some loss of precision be designed to have the wire guide spaced a greater distance from the spool flange, and utilize a greater ratio of flange-to-core diameter. If the wire guide is to remain at a fixed position with respect to the spool axis, for such a larger ratio, then a proportionally greater distance will exist between the guide and the run-on location. This, of course, will call for a corresponding increase in the distance that the wire guide is "kicked" during transistion from one layer to the next. Of course, for wire of markedly different sizes or shapes from those described in the preferred embodiment, corresponding scaling or re-proportioning of all parts of the apparatus would be clearly indicated. Even for this size wire, spools of different sizes may be used advantageously for different applications, or for wire having a different composition and therefore different mechanical behaviour. It will thus be clear that the scope of the invention is determined entirely by the claims appended, which individually cover the different aspects of the invention.

What is claimed:

1. An apparatus for winding wire on a spool having a prescribed width comprising guide menas for guiding a length of wire onto said spool to be wound around said spool; means for rotating said spool about an axis to cause said wire to be wound around said spool; traverse means for moving said guide means and said spool relative to each other and parallel to said axis to wind said wire helically about said spool with a prescribed lay width; first digital means for providing a rotation signal corresponding to increments of angular rotation of said spool; second digital means for providing a translation signal corresponding to increments of axial displacement between said guide element and said spool; third digital means for providing a lay width signal; fourth digital means for providing a spool width signal; and processing means for comparing said translation signal with a value computed from said rotation signal, said lay width signal and said spool width signal and for providing a control signal to said traverse means based on said comparison.

2. An apparatus as claimed in claim 1 wherein said rotation signal is a pulse string; said second digital means is an absolute position encoder; and said third and fourth digital means is each a respective manually adjusted encoder.

3. An apparatus for winding wire on a spool having a prescribed width comprising guide means for guiding a length of wire onto said spool to be wound around said spool; means for rotating the spool about an axis to cause said wire to be wound around said spool; and traverse means for moving said guide means and said spool relative to each other and parallel to said axis to wind said wire helically about said spool with a prescribed lay width; said traverse means causing said wire to be wound about said spool from a first end position to a second end position and back to said first end position in a series of passes; said traverse means in moving said wire from said second end position back to said first end position causing said guide element and said spool to move relative to each other first in a transition phase at a relatively high speed and then at a substantially constant lower speed, said relatively high speed being maintained for sufficiently long period to move said guide elements and said spool relative to each other a distance equal to at least approximately one-fourth said prescribed lay width.

4. An apparatus as claimed in claim 3, wherein said relatively high speed is at least approximately ten times said constant lower speed.

5. An apparatus as claimed in claim 3, wherein said transition phase lasts sufficiently long enough to move said guide element and said spool relative to each other a distance between approximately one-quarter and one-third said prescribed lay width.

6. An apparatus as claimed in claim 5, wherein said relatively high speed is at least approximately ten times said constant lower speed.

7. An apparatus as claimed in claim 3 further comprising first digital means for providing a rotation signal corresponding to increments of angular rotation of said spool; second digital means for providing a translation signal corresponding to increments of axial displacement between said guide elements and said spool; third digital means for providing a lay width signal; fourth digital means for providing a spool width signal; and processing means for comparing said translation signal with a value computed from said rotation signal, said lay width signal and said spool width signal and for providing a control signal to said traverse means based on the comparison.

8. An apparatus as claimed in claim 7, wherein said rotation signal is a pulse string, said second digital means is an absolute position encoder, and said third and fourth digital means is each a respective manually adjusted encoder.

9. An apparatus as claimed in claim 8, wherein said relatively high speed is at least approximately ten times said constant lower speed.

10. An apparatus as claimed in claim 9, wherein said transition phase lasts sufficiently long enough to move said guide elements and said spool relative to each other a distance between approximately one-quarter and one-third said prescribed lay width.

* * * * *